US008746295B2

(12) United States Patent
Mueller et al.

(10) Patent No.: US 8,746,295 B2
(45) Date of Patent: Jun. 10, 2014

(54) FILLING APPARATUS

(75) Inventors: Martin J. Mueller, Oldsmar, FL (US); Michael A. Weigandt, Palm Harbor, FL (US)

(73) Assignee: Osgood Industries, Inc., Oldsmar, FL (US)

( * ) Notice: Subject to any disclaimer, the term of this patent is extended or adjusted under 35 U.S.C. 154(b) by 829 days.

(21) Appl. No.: 12/863,343

(22) PCT Filed: Jan. 20, 2009

(86) PCT No.: PCT/US2009/000334

§ 371 (c)(1), (2), (4) Date: Feb. 21, 2011

(87) PCT Pub. No.: WO2009/091608

PCT Pub. Date: Jul. 23, 2009

(65) Prior Publication Data

US 2011/0139814 A1 Jun. 16, 2011

Related U.S. Application Data

(60) Provisional application No. 61/011,660, filed on Jan. 18, 2008.

(51) Int. Cl.
*B65B 3/12* (2006.01)
*B65B 3/32* (2006.01)

(52) U.S. Cl.
CPC .... *B65B 3/12* (2013.01); *B65B 3/32* (2013.01)
USPC ..... 141/94; 141/9; 141/104; 141/242

(58) Field of Classification Search
CPC ..... B65B 3/12; B65B 3/32
USPC ..... 141/1, 9, 94, 104, 237, 242–245
See application file for complete search history.

(56) References Cited

U.S. PATENT DOCUMENTS 3,695,486 A * 10/1972 Warner ..... 222/162
4,239,177 A 12/1980 Williams et al.

(Continued)

FOREIGN PATENT DOCUMENTS

EP 401407 A1 * 12/1990 ..... B65B 3/32
WO 2005 017356 A1 2/2005

OTHER PUBLICATIONS

International Search Report and Written Opinion in corresponding PCT application PCT/US2009/000334 dated Mar. 12, 2009.

*Primary Examiner* — Gregory Huson
*Assistant Examiner* — Nicolas A Arnett
(74) *Attorney, Agent, or Firm* — Wood, Phillips, Katz, Clark & Mortimer

(57) ABSTRACT

A filling apparatus for serially filling multiple lanes of containers includes a plurality of piston pumps which receive flowable product from an associated source. Each pump includes a reciprocably movable pump piston, which can "float" upwardly during a filling stroke, as each pump is filled with product delivered thereto under pressure. The pump pistons can move upwardly independently, until each reaches a predetermined position, corresponding to the quantity of product with which each container is to be filled. After all of the pistons reach their respective predetermined positions, valves of the pumps are simultaneously operated, and the pistons simultaneously stroked so that respective containers are filled with the flowable product. The multiple lanes of containers are thereafter indexed, and the filling cycle repeated.

9 Claims, 6 Drawing Sheets

(56) References Cited

U.S. PATENT DOCUMENTS

| | | | | |
|---|---|---|---|---|
| 4,730,648 | A * | 3/1988 | Walter | 141/91 |
| 5,127,449 | A * | 7/1992 | Mueller et al. | 141/1 |
| 5,707,212 | A | 1/1998 | Matthews | |
| 7,108,024 | B2 * | 9/2006 | Navarro | 141/127 |
| 2006/0266003 | A1 * | 11/2006 | Topf et al. | 53/281 |
| 2008/0047628 | A1 * | 2/2008 | Davidson et al. | 141/18 |

* cited by examiner

PRODUCT INFEED TO PISTON
SPOOL IN PRODUCTION POSITION

PRODUCT DISCHARGE TO CUP
SPOOL IN PRODUCTION POSITION

FIG. 8
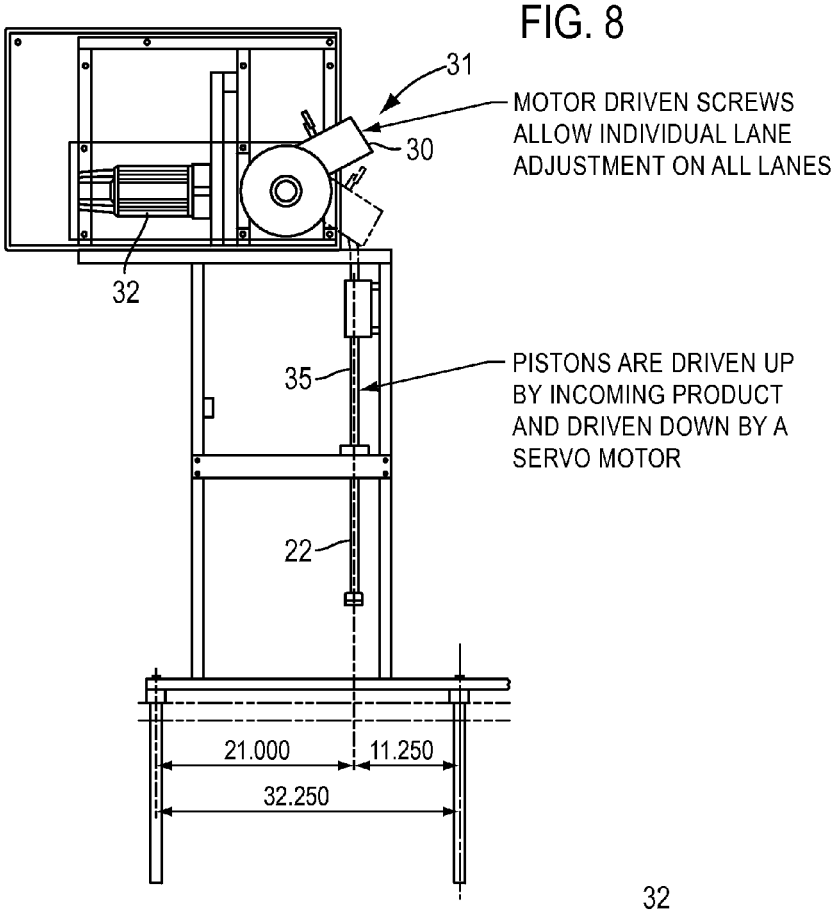
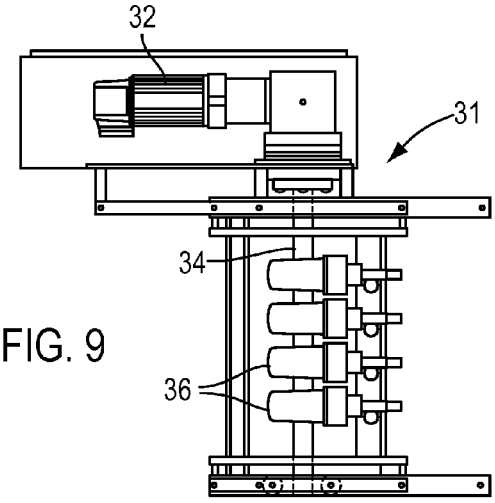
FIG. 9

FILLING APPARATUS

CROSS-REFERENCE TO RELATED APPLICATION

This application claims the benefit of priority Provisional Application No. 61/011,660, filed Jan. 18, 2008, the disclosures of which is incorporated herein by reference.

TECHNICAL FIELD

The present invention relates generally to a filling apparatus for filling containers with flowable product, such as ice cream, and more particularly to a filling apparatus which facilitates serially filling multiple lanes of containers, and which balances product flow between the lanes by providing a plurality of pumps, each having a piston which can independently "float" during filling with product. After all of the pumps receive the desired quantity of product, the pistons are simultaneously stroked so each container receives the desired quantity of product.

BACKGROUND OF THE INVENTION

Heretofore, various arrangements are known for effecting filling of containers with flowable product, such as ice cream or the like. This type of product, sometimes referred to as "high overrun", can be problematic to fill effectively, in view of the air which the product contains. Accurate and efficient filling of containers can be complicated by the nature of such high overrun products.

Heretofore, filling arrangements have typically been configured as a "single lane", that is, with a single source of the flowable product serially and individually filling containers as they are moved with respect to the product source. Use of servo-lift tables for holding each container as it is filled, such as disclosed in U.S. Pat. No. 5,787,687, hereby incorporated by reference, permits accurate container filling, with the servo-lift table generally functioning ad a servo-weight cell control.

While in previous systems the lift table was the trigger for controlling flow, the present invention facilitates filling of multiple lanes of containers, with the positions of pistons of multiple fill pumps utilized to manipulate product, instead of direct extrusion.

SUMMARY OF THE INVENTION

In accordance with the present invention, a novel filling apparatus, and method of filling containers, are disclosed by which multiple lanes of containers can be efficiently filled with flowable food product, such as ice cream, directed under pressure from a single source. In distinction from previously-known single lane filling arrangements, the present system includes a plurality of piston pumps, wherein the pistons are permitted to "float", and move independently of each other as product is introduced, under pressure, from the associated source into the plurality of pumps. When all of the pistons, floating independently, each reach a respective predetermined position, the pistons are simultaneously driven by an associated drive mechanism, thereby each filling a respective container with the desired quantity of product. The containers are thereafter indexed, and the pumps refilled, for efficiently filling multiple lanes of containers.

In accordance with the illustrated embodiment, the present apparatus includes a plurality of pumps each having a pump housing defining an inlet for receiving flowable product from an associated source, and an outlet for discharging the product to a respective container. Each pump further includes a pump chamber which can alternatively communicate with the inlet and the outlet, and a pump piston movably disposed within the respective pump chamber. By this arrangement, product can be directed inwardly from the inlet to the chamber, and outwardly from the chamber through the outlet by reciprocable movement of the piston.

Each of the pumps further includes a moveable valve member, preferably a rotary valve member, positioned within the housing, and moveable between a first position for joining the inlet in communication with the pump chamber, and a second position for joining the chamber in communication with the outlet.

The apparatus includes a valve drive motor operatively connected to each of the valve members for simultaneously moving each of the valve members between its first and second positions.

In accordance with the present invention, a plurality of sensors are provided which are respectively operatively associated with each of the pumps to indicate when the respective piston has moved to a predetermined position, attendant to flow of product into the respective one of the chambers. This predetermined position corresponds to the quantity of product to be pumped into each of the containers being filled, with the pistons permitted to "float" under the influence of the pressurized product.

A piston drive mechanism, operatively connected with each of the pistons, is operated when all of the pistons reach the predetermined position by flow of product into the respective one of the chambers. The piston drive mechanism simultaneously drives the pistons, after the valve drive motor simultaneously moves each of the valve members from the first position to the second position thereof. In this manner, the pistons simultaneously force the product from the respective chambers through the respective outlets and into respective ones of the containers. Thereafter, the valve drive motor is operated to simultaneously move each of the valve members from the second position to the first position thereof so that the cycle can be repeated.

As noted, each of the valves preferably comprises a rotary valve, which is rotatably positionable with respect to the pump housing. In the preferred embodiment, the valve drive motor is operatively connected with each of the valve members by a rack-and-pinion drive mechanism. Notably, CIP (clean in place) of the apparatus is facilitated by configuring the apparatus such that the valve drive motor and valve members are moveable, as a unit, relative to the pump housings, to thereby facilitate cleaning of the pumps.

In the preferred form, the piston drive mechanism includes a plurality of adjustment motors for individually adjusting each of the pistons with respect to the piston drive mechanism.

In previous arrangements, filling ice cream had been effected in single lanes, directly extruding the ice cream flow into the container, and cutting it off with the servo-index. With filling of multiple lanes, balancing a number of lanes with flow from one outlet pipe can be problematic, especially with premium ice creams. The new system utilizes a piston pump for each container lane, and desirably avoids use of squeeze or pinch valves to restrict flow from one lane to the other to balance the weight and volume. Flowable product is driven out, under power, by the pump pistons, but the pistons are then permitted to "float", as the flowable product flows into each pump. In other words, the pistons are not retracted by the associated drive.

The point to which each piston is permitted to float as the respective pump is filled with product can be varied to accommodate filling of containers of differing sizes. The pistons are thus pushed by the ice cream flow the proper distance, and then stopped by the piston drive. Each piston operates independently, and will be moved at the flow rate of the process. As each piston gets to the end of the stroke (proper volume), it stops and triggers an input to the PLC (programmed logic controller). A sensor at the top of each piston is energized when the pump has received a predetermined quantity of product. The pistons are operated independently, with the apparatus permitting all of the pumps to fill to the desired level, thereby desirably acting to automatically balance the flow of product from the associated source to the multiple filling lanes. A sensor at the top of each piston is energized which send a signal to the servo-indexer to move the carriers.

When all of the pumps have received the desired quantity of product, rotary valves of the pumps are simultaneously operated, and the pistons simultaneously driven to dispense product to the respective containers in the multiple lanes. When the pistons reach the end of the dispensing stroke, the rotary valves are simultaneously operated to again allow the ice cream to fill the pump chambers, as the pistons float upwardly in response to product flow. At the same time, the piston drive is moved back to the start position to allow the filling of the pump chambers.

The carriers are preferably of the lift design for holding tapered cups in a strong position to wipe-cut the ice cream, and allow the servo-lift to retract just in time to allow the next container to be presented to the nozzle, and the next flow of ice cream. See U.S. Pat. No. 5,987,687, hereby incorporated by reference. A desirable feature of the present invention is that it can be provided with a CIP (clean in place) option.

In a current embodiment, a single piston drive utilizes a servo-motor driving one shaft, with individual fill adjusting mechanisms on each lane. However, it is within the purview of the present invention that individual adjustments may not be necessary, and that the drive could be effected pneumatically, or cam-driven, but a servo-drive provides desired response time with enhanced versatility. It is within the purview of the present invention that individual servo-drives be provided for each line. In accordance with the present invention, each rotary valve of the filling apparatus is preferably provided with a pulling mechanism to pull the valve to a cleaning position, and to place the valve back into its running position.

Other features and advantages of the present invention will become readily apparent from the following detailed description, the accompanying drawings, and the appended claims.

BRIEF DESCRIPTION OF THE DRAWINGS

FIG. 8 is a further diagrammatic view illustrating the arrangement for operating the pistons of the present filling apparatus; and FIG. 9 is a further diagrammatic view illustrating the arrangement for operating the pistons of the present filling apparatus.

DETAILED DESCRIPTION

Figure 1:
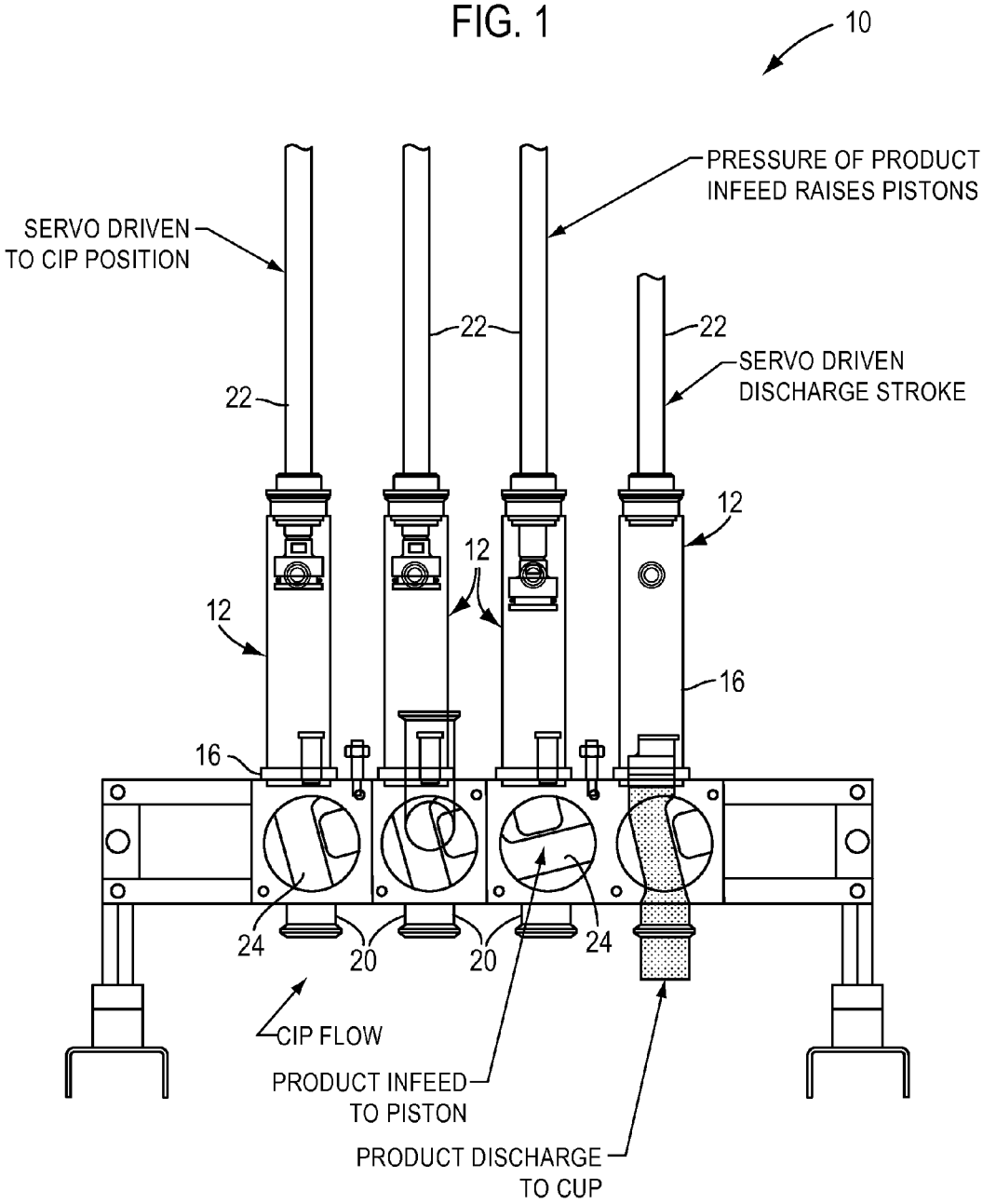
FIG. 1 is a diagrammatic view of a filling apparatus embodying the principles of the present invention.
Figure 2:
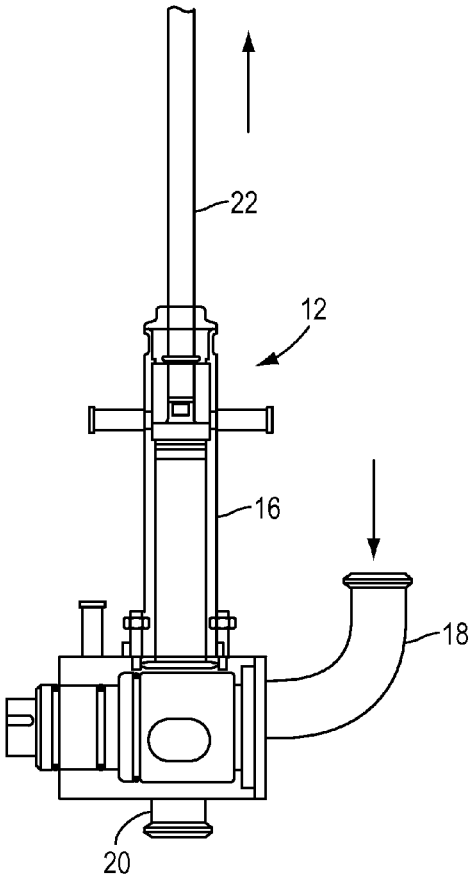
FIG. 2 is a diagrammatic view illustrating filling of a piston pump of the present apparatus.
Figure 3:
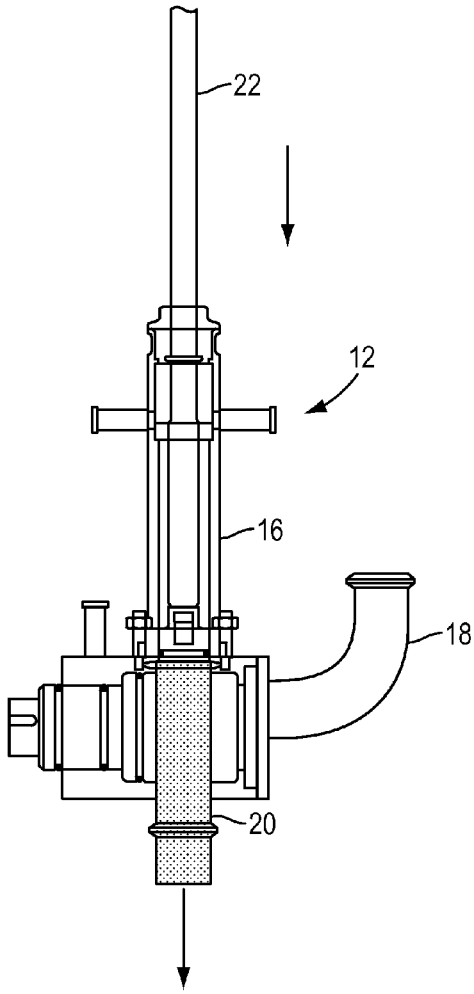
FIG. 3 is a diagrammatic view illustrating discharge of product from a piston pump of the present apparatus.
Figure 4:
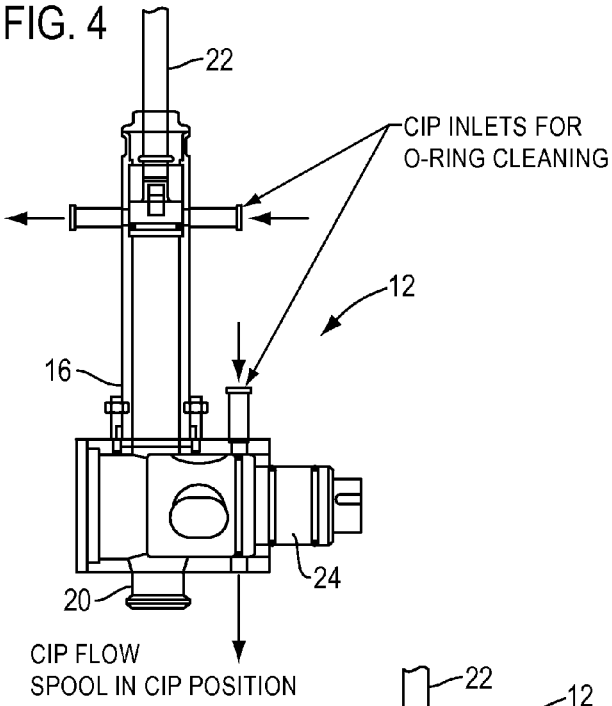
FIG. 4 is a diagrammatic view illustrating cleaning-in-place of a piston pump of the present apparatus.
Figure 5:
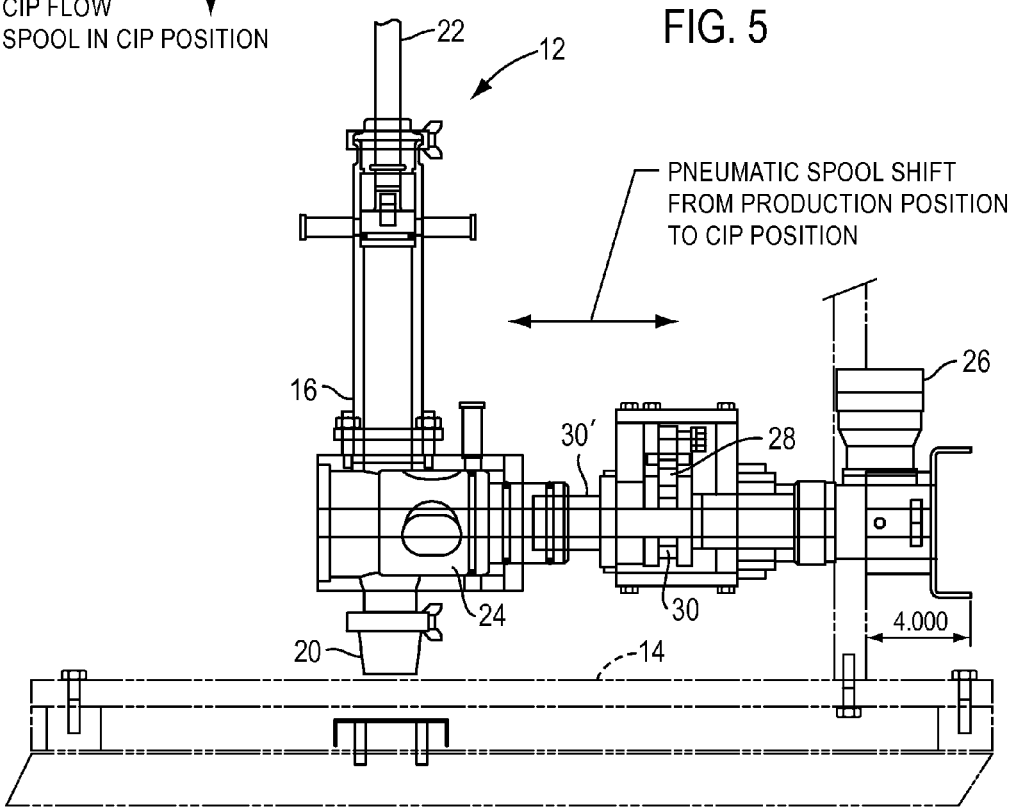
FIG. 5 is a diagrammatic view illustrating an arrangement for simultaneously operating rotary valves of the piston pumps of the present filling apparatus.
Figure 6:
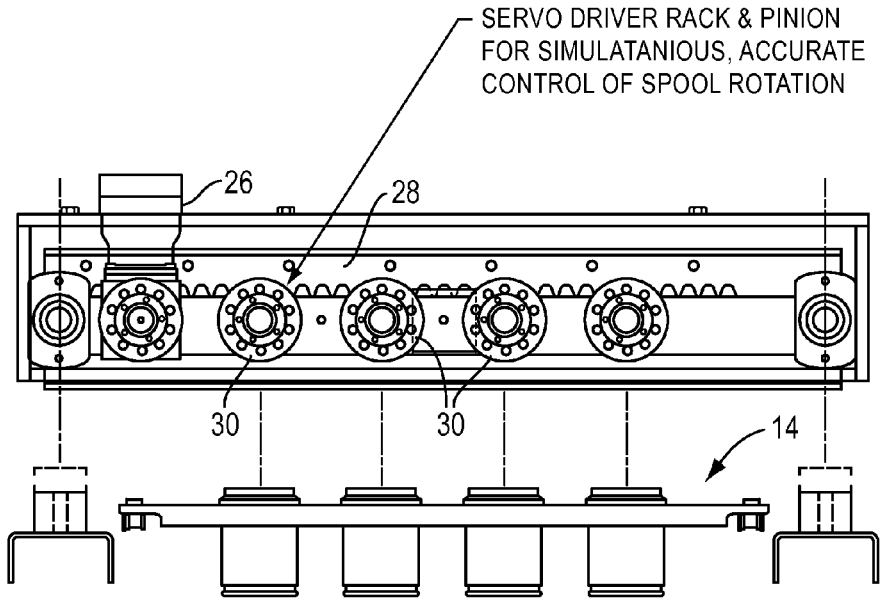
FIG. 6 is a diagrammatic view further illustrating the arrangement for simultaneously operating the valves of the present apparatus.

While the present invention is susceptible of embodiment in various forms, there is shown in the drawings, and will hereinafter be described, a presently preferred embodiment, with the understanding that the present disclosure is to be considered as an exemplification of the invention, and is not intended to limit the invention to the specific embodiment illustrated.

In accordance with the present invention, a filling apparatus 10 includes a plurality of piston pumps 12 which are positioned in operative association with a container conveyor 14 for serially filling multiple lanes of containers with flowable food product. Notably, the present invention operates such that flow of product from an associated source, under pressure, is directed into a pump chamber defined by each of the piston pumps 12. As will be further described, a piston of each of the pumps can "float" and move independently with respect to the other pistons, as food product flows into the respective pump. In other words, the pistons are not retracted by the associated drive, but move upwardly under the influence of the pressurized product.

After each of the pump pistons is moved to a respective predetermined position, a piston drive mechanism is operated to simultaneously operate the pumps, stroking them downwardly, thereby forcing the flowable product from each of the pumps into a respective one of the containers. The container conveyor can thereafter be indexed, and the pump operation cycle repeated so that each pump is thereafter filled with flowable product, and operated to force the product into a respective one of the containers.

Each piston pump 12 includes a pump housing 16 which defines an inlet 18 for receiving product, under pressure, from an associated source, and an outlet 20 for directing the flowable product from the pump into a respective one of the containers on container conveyor 14. Each pump housing 16 defines a chamber within which a respective pump piston 22 is reciprocably moveable, so that each pump chamber can be filled with product, delivered under pressure, which acts to move the respective piston 22 upwardly, referring to the orientation of the illustrated embodiment. Thereafter, as will be described, the pump pistons 22 are simultaneously driven downwardly, whereby flowable product is delivered from each of the piston pumps 12 to a respective one of the containers.

As illustrated, each of the piston pumps 12 includes a rotatably positionable rotary valve member 24 positioned for rotary movement within the respective pump housing 16. Rotatable movement of each rotary valve 24 alternately joins the inlet 18 and outlet 20 of each pump in respective fluid communication with the pump chamber within which the respective piston 22 is moveable.

Simultaneous operation of the rotary valve members 24 is effected by a valve drive servo-motor 26 which is operatively connected with each of the valve members for simultaneously moving the valve members between the first and second positions thereof. In the illustrated embodiment, a rack-and-pinion drive mechanism is provided for operatively connecting the valve drive motor 26 with each of the valve members 24. In particular, the motor 26 reciprocably moves a gear rack 28, which in turn is in operative engagement with a plurality of pinion gears 30, respectively joined to the rotary valve members 24 by couplings 30'.

Simultaneous operation of pump pistons 22 is effected by a piston drive mechanism 31 operatively connected with each of the pistons. In the illustrated embodiment, a single servo-drive pump motor 32 operates through a pump drive shaft 34 and coupling 35 for simultaneously driving the pump pistons 22 downwardly during the container-filling stroke of the apparatus 10. However, it is within the purview of the present invention that individual drive motors could be employed for each of the pump pistons, or that the drive could be pneumatically-driven or cam-driven. However, use of a servo-drive has been found to provide the desired response time, with optimal flexibility of operation.

The interconnection of each pump piston 22 with the pump drive shaft 34 is configured to provide a one-way drive action, that is, each of the pump pistons is permitted to "float" or move upwardly with respect to the drive shaft after the shaft is moved back to its start position, and as the respective pump is filled with flowable product from the associated source. Attendant to operation of the pump drive motor 32, all of the pistons 22 are simultaneously driven downwardly, thereby dispensing flowable product from each piston pump 12 into a respective one of the containers. If desired, a plurality of adjustment motors 36 can be provided, which operate between each pump piston 22 and the drive shaft 34, to individually adjust the position of each pump piston relative to the drive shaft.

From the foregoing, operation of the present invention will be readily appreciated. The apparatus 10 indexes a new container into the filling position by operation of container conveyor 14. A suitable lift arrangement (not shown) can operate to lift each cup into place under a respective one of the piston pumps 12. Product flows continually from an associated source into each of the piston pumps 12 and is directed from the inlet 18 of each pump, by the respective rotary valve member 24, into the pump chamber so that the respective pump piston 22 moves upwardly under the influence of pressurized product flow. Thus, in a first position of each of the valve members 24, the inlet of the pump is joined in fluid communication with the pump chamber, whereby pressurized flow of product into the pump moves each pump piston as it "floats" upwardly, with respect to the associated piston drive mechanism.

Figure 7:
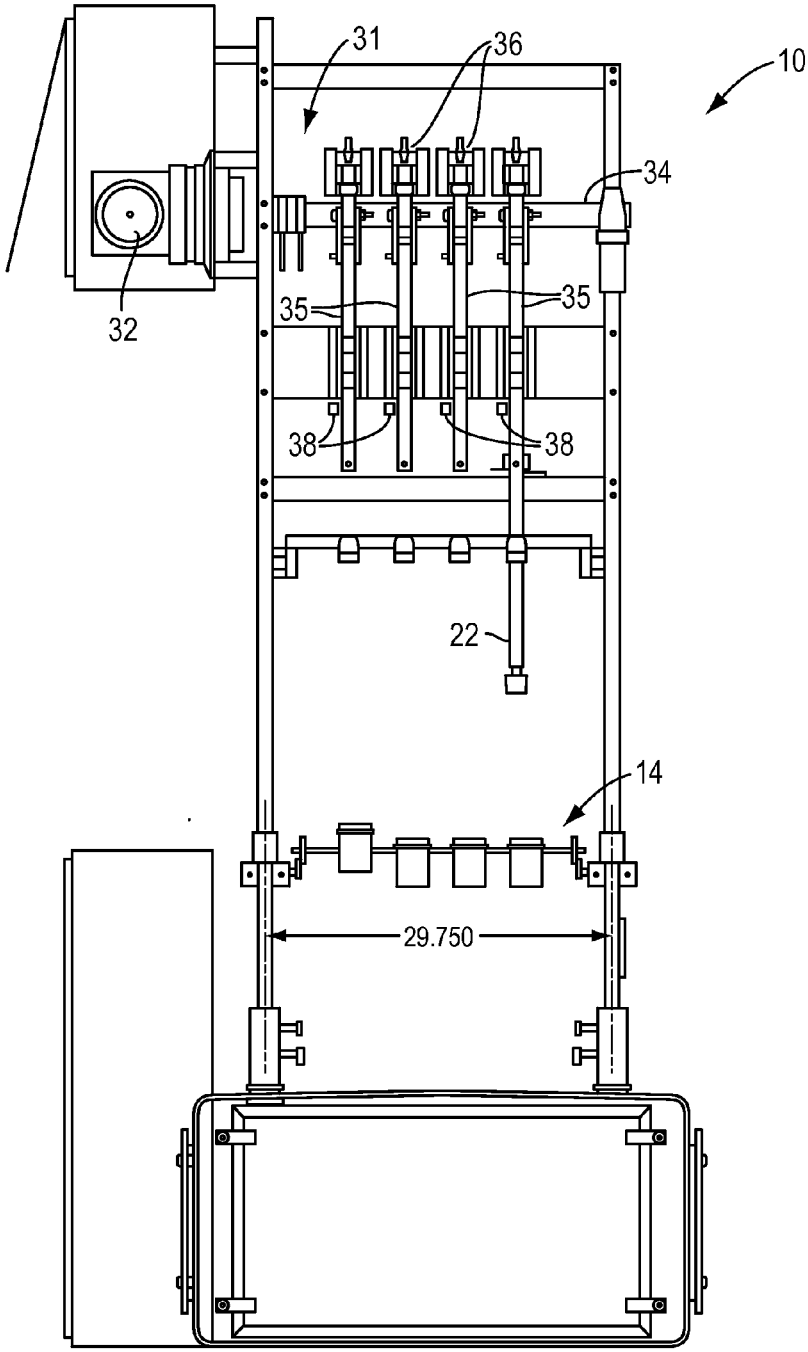
FIG. 7 is a diagrammatic view of the arrangement for operating the pistons of the present filling apparatus.

Each of the pistons 22 can move independently during this fill stroke, with each piston moving to a respective predetermined position, corresponding to the quantity of flowable product to be introduced into each of containers being filled. To monitor the position of the pistons, the filling apparatus 10 includes a plurality of sensors 38 (FIG. 7) which provide a signal to an associated logic controller of the apparatus when each of the pistons 22 reaches its respective predetermined position. As will be appreciated, by virtue of the pistons being independently moveable, it is not necessary that the pistons simultaneously reach their predetermined positions, thereby providing the desired "balance" of flow among the plurality of piston pumps 12.

After each of the pistons 22 has reached its respective predetermined position and is stopped by engagement with the pump drive, the programmable controls of the filling apparatus 10, having received a signal from each of the piston sensors, operates to simultaneously move the rotary valve members 24 from the first position thereof, to a second position thereof, wherein each pump chamber is placed in fluid communication with the associated pump outlet 20. Thereafter, the pump drive motor 32 is operated to simultaneously drive each of the pistons 22, in unison, via the pump drive shaft 34, so that product flows from the chamber of each piston pump 12 into a respective one of the containers on the container conveyor 14.

When all of the pistons 22 reach the end of the stroke, the valve motor 26 is again operated to simultaneously move the rotary valve members from their second positions to their first positions, to thereby permit flowable product to again flow into the chamber of each pump. At the same time, the piston drive mechanism is operated to move back to its start position, to thereby allow the filling of the pump chambers as the pistons 22 are permitted to "float" under the influence of the pressurized flowable product moved into each of the piston pumps.

A feature of the present invention which facilitates cleaning of the apparatus includes an arrangement by which the rotary valve members 24, and the associated valve drive motor, are moveable, as a unit, relative to the pump housings 16, to thereby facilitate cleaning of the pumps.

A current embodiment of the present filling apparatus has been configured for filling containers with ice cream. Features of the design allow the pump pistons to move vertically, with the inlet for each pump arranged from either the leading or trailing side of the pump, referring to the movement of the associated containers. This allows desirable flexibility in installation, with minimization of the space utilized.

The operation of the pump is controlled and coordinated by a programmable logic controller (PLC), with use of three (3) servo-drives to coordinate the filling. As described, one common drive is employed for driving the pistons of the pumps, one drive for operation of the valve spools, with an associated drive employed for operation of the container fill lift mechanism. As described, four (4) individual "fine adjust" motors are employed for individually adjusting the positions of the pump pistons. This desirably allows the operator to adjust the stroke of each line for slight volume adjustments. Major adjustments, or size changes, are accomplished by adjusting the common piston drive. The speed of the filler is driven by the product flow.

As noted, operation includes indexing the product conveyor of the apparatus so that a new container is moved into the filling position. The fill lift can thereafter lift each container into place under a respective one of the piston pumps.

Ice cream flows into the pumps continuously, and is directed to each of the pump pistons by the respective rotary valve member. The pistons are pushed by the ice cream flow the proper distance, and stopped by the piston pump drive. Each piston operates independently, and will be moved at the flow rate of the process. As each piston gets to the end of the stroke (proper volume) the piston stops and triggers an input to the PLC.

Once each piston is in place, the valve servo-drive operates to simultaneously rotate the rotary valve members in unison. Thereafter, at the appropriate time, the pump pistons are stroked downwardly, and fill ice cream into each of the respective containers. While each container is being filled, the fill lift may be moving downwardly to allow for and control the filling look and pattern in each container.

As the pistons near the end of the filling cycle, the index of the filler will be triggered to wipe the cup across the respective filling nozzle. When the pistons reach the end of the stroke, the rotary valve members are shifted back to the first position to allow ice cream to again fill each pump. At the same time, the piston drive is returned to its start position to allow filling of each pump chamber. The cycle repeats, and is driven by the ice cream flow to the pumps.

As will be appreciated, the present invention provides a highly efficient arrangement for serially filling multiple lanes of containers with flowable product. The present invention desirably avoids resort to squeeze or pinch valves, or the like, to restrict flow from one filling lane to another in an effort to balance weight and volume. By the present invention, balance of flow between the various filling lanes is achieved by permitting the pistons to "float" with respect to the associated piston drive, as the pistons are moved by product flow as each pump is filled. The pistons are then driven, under power, during the filling stroke.

It will be readily observed from the foregoing detained description of the invention and from the illustrations thereof that numerous other variations and modifications can be effected without departing from the true spirit and scope of the novel concepts or principles of this invention.

What is claimed is:

1. An apparatus for filling multiple lanes of containers with flowable product, comprising:

a plurality of pumps each having a (1) pump housing defining: an inlet for receiving said flowable product from an associated source, an outlet for discharging the product to a respective container, and a pump chamber which can communicate with the inlet and the outlet, each said pump further including (2) a piston movably disposed within the respective pump housing, so that said product can be directed inwardly from said inlet to said chamber, and outwardly from said chamber through said outlet by reciprocable movement of said piston, and (3) a movable valve member positioned within said housing movable between a first position for joining said inlet with said chamber, and a second position for joining said chamber with said outlet;

each of said pistons being driven by said flowable product and being movable independently of the other ones of said pistons as said plurality of pumps each filled with said flowable product, a valve drive motor operatively connected to each of said valve members for simultaneously moving each of said valve members between its first and second position;

a plurality of sensors respective operatively associated with each of said pumps to indicate when the respective piston has moved to a predetermined position attendant to flow of said product into the respective one of said chambers; and a piston drive mechanism operatively connected with each of said pistons, said piston drive mechanism being operated when all of said pistons reach said predetermined position by flow of product into the respective ones of said chambers, said piston drive motor mechanism simultaneously driving said pistons, after said valve drive motor simultaneously moves each of said valve members from the first to the second position thereof, so that said pistons simultaneously force said product from the respective chambers through the respective outlets into respective ones of said containers, said valve drive motor thereafter simultaneously moving each of said valve members from the second position to the first position thereof.

2. An apparatus for filling containers in accordance with claim 1, wherein:

each of said valve members comprises a rotatably positionable valve member.

3. An apparatus for filling containers in accordance with claim 2, wherein:

said valve drive motor and said valve members are movable, as a unit, relative to said pump housings, to facilitate cleaning of said pumps.

4. An apparatus for filling containers in accordance with claim 1, wherein:

said valve drive motor is operatively connected with each of said valve members by a rack-and pinion drive mechanism.

5. An apparatus for filling containers in accordance with claim 1, wherein:

said piston drive mechanism comprises a servo-drive motor.

6. An apparatus for filling containers in accordance with claim 1, wherein:

said piston drive mechanism includes a plurality of adjustment motors for individually adjusting each of said pistons with respective to the piston drive mechanism.

7. A method for serially filling multiple lanes of containers with a flowable product, comprising the steps of:

providing a source of said flowable product;

providing a plurality of pumps each having a housing defining an inlet, an outlet for discharging the product to a respective container, and a pump chamber, each pump having a piston movably disposed within the chamber so that by movement of the piston said product can be received in said chamber from said inlet, and directed from said chamber to said outlet, by reciprocable movement of said piston, each said pump including a valve for alternate joining said chamber in communication with said inlet and said outlet;

directing said flowable product to each of said pumps, each of said pistons being driven by said flowable product and being movable independently of the other ones of said pistons as said plurality of pumps each filled with said flowable product, simultaneously positioning said valves in a first position wherein said product flows from the inlet into said chamber and acts against the respective piston to move the piston to a predetermined position corresponding to the desired quantity of product to be dispensed, said pistons being movable independently of each other;

simultaneously operating said valves, after all of said pistons have moved to their respective predetermined positions, to move each of said valves from said first position thereof to a second position for directing the product from the chamber out of the outlet of the pump into a respective container; and simultaneously driving said pistons to move said product into respective containers.

8. A method for serially filling multiple lanes of containers in accordance with claim 7, including:

individually adjusting the predetermined position of each of said pistons.

9. A method for serially filling multiple lanes of containers in accordance with claim 7, including:

relatively moving said valves, in unison, relative to said housings of said pumps to facilitate cleaning of said pumps.

* * * * *